US006695795B2

(12) United States Patent
Knoll

(10) Patent No.: US 6,695,795 B2
(45) Date of Patent: Feb. 24, 2004

(54) THERAPEUTIC DEVICE

(75) Inventor: Gerd Knoll, Umkirch (DE)

(73) Assignee: Medireha GmbH, Umkirch (DE)

( * ) Notice: Subject to any disclaimer, the term of this patent is extended or adjusted under 35 U.S.C. 154(b) by 281 days.

(21) Appl. No.: 09/748,740

(22) Filed: Dec. 26, 2000

(65) Prior Publication Data

US 2002/0082530 A1 Jun. 27, 2002

(30) Foreign Application Priority Data

Dec. 27, 1999 (DE) ..... 199 63 200

(51) Int. Cl.[7] ..... A61H 1/02
(52) U.S. Cl. ..... 601/5; 601/26; 601/33
(58) Field of Search ..... 601/5, 24, 33, 601/26

(56) References Cited

U.S. PATENT DOCUMENTS 5,163,451 A * 11/1992 Grellas ..... 601/33
5,255,188 A * 10/1993 Telepko ..... 601/5
5,320,641 A * 6/1994 Riddle et al. ..... 601/24
5,417,643 A * 5/1995 Taylor ..... 601/33
6,152,855 A * 11/2000 Dean et al. ..... 601/24

FOREIGN PATENT DOCUMENTS

EP 0 147 645 A2 7/1985
EP 0 147 645 B1 5/1989

* cited by examiner

*Primary Examiner*—Danton D. DeMille
(74) *Attorney, Agent, or Firm*—Oppenheimer Wolff & Donnelly LLP

(57) ABSTRACT

Continuous passive body motion is efficiently and effectively treated by a therapy device which includes at least one movable body carrying element which is driven by a controlled motion drive to produce the desired movement. The motion drive controller includes at least data reading element which cooperates with a program data media to provide individualized control of the therapy device. This individual control will be specifically adapted for each particular patient, thus allowing therapy to occur without the need for operators.

26 Claims, 1 Drawing Sheet

THERAPEUTIC DEVICE

BACKGROUND OF THE INVENTION

The invention relates to a therapeutic device with at least one body carrying element which, for the purpose of performing the continuous passive body motion involving a patient, is movable by means of at least one motion apparatus, with at least one motion drive being control-connected with a control device.

Such therapy devices are known to exist in various designs. Therapy devices have been created which serve, for instance, to remobilize shoulder, elbow or knee joints after surgical interventions by means of continuous passive motion.

SUMMARY OF THE INVENTION

The invention relates to a therapy device (1) with at least one body carrier element capable of being moved for the purpose of performing a continuous passive body motion of a patient using at least one motion drive (17), with at least one motion drive (17) being control-connected to a control device. One of the characterizing features of the therapy device (1) provides for the control device having a control program reader (18) in which machine-readable control program data media (19) can be read, with a personalized and individual patient control program being stored on said control program data media. The therapy device (1) according to the invention can be operated easily and conveniently also by untrained and unskilled users and operators (cf. FIG. 1).

A therapeutic device is known from EP 0 147 645 which serves the treatment of a shoulder or elbow joint and which has an arm rail for supporting and/or propping the arm. The arm rail is connected to a support frame in the patient's head region which, in turn, is connected to the patient's body. Pivot drives are arranged between the support frame and the arm rail such that a vertical swivel movement and a horizontal swivel movement, respectively overlaid, combined movements of the arm are permitted for motion therapy.

By turning an upper part section of the support frame by 180°, the support frame can optionally be arranged on the left hand side or the right hand side. Changing the sides of the known therapy device, however, requires the connections between the individual components to be cumbersomely loosened and reassembled in mirror fashion. Also, handling and programming the known therapeutic device requires a great deal of time and skill which may make it difficult for patients to operate the device by themselves.

The need was therefore to develop a therapy device which is particularly easy to handle.

The solution of this task according to the invention is provided in the therapy device mentioned in the first paragraph by integrating a control program reader in the control device and by the fact that machine-readable control program data media can be read into the control program reader on which control programs individual to each patient can be stored.

The motion drives required for the continuous motion of the body carrier element of the therapy device as presented in this invention are control-connected with a control device fitted with a control program reader. Machine-readable control program data media, on which a control program specific and individual to each patient is stored, can be read into the control program reader. By inserting the control program data media into the control program reader and reading the data stored on the control program data media, the therapy device according to the invention can be automatically controlled in compliance with the therapy and treatment values recommended by the physician, such as the angle envisaged for the postoperative mobilization of a shoulder joint or for the continuous adduction, abduction, elevation and/or rotary movement or for anteversion or retroversion. By changing the control program data media, the device is easily and without much effort adapted to the therapy regime or protocol assigned to the next patient without the need for skilled or qualified personnel.

The control program data media may be designed as punchcards or similar machine-readable data media. The handling of the therapy device according to the invention is, however, substantially facilitated if the control program data media are designed as magnetic strip and/or as chip card.

The therapy device according to the invention may also be designed as training cycle in which the body carrier elements are designed as pedals in order to be able to continuously move the patient's feet resting on it in one level of rotation. The preferred design, however, assigns the therapy device for the treatment of a shoulder, elbow, hip, knee, ankle, hand and/or finger joint.

One further proposal relates to a therapy device for the treatment of shoulder and/or elbow joints using an arm rail attached to a device carrier with shoulder pivot joints in such a manner that the point of intersection of their joint axes is located roughly in the patient's shoulder region. According to the invention, it is envisaged in such a therapy device that a first shoulder pivot joint roughly defining a horizontal pivot level is arranged below the seating surface for the seated patient or is adjustable such that the arm rail is linked to the first shoulder pivot joint via a specially curved or angled connecting arm and that a second shoulder pivot joint roughly defining a vertical pivot level is arranged between the arm rail and the connecting arm.

The therapy device intended specially for the mobilization of a shoulder and/or an elbow joint has a first shoulder pivot joint roughly defining a horizontal pivot level arranged underneath a seating surface. With such an arrangement, the usual configuration of this shoulder pivot joint near the patient's head, where the user normally perceives such components as irritating and where such components are likely to restrict the pivot angle of the arm rail to a substantial degree, becomes dispensable. The therapy device according to the invention also has a second shoulder pivot joint which defines a roughly vertical pivot level for the arm rail. The shoulder pivot joints of the therapy device according to the invention therefore allow a vertical swivel motion and a horizontal swivel motion during comprehensive motion therapy, and also overlaid, combined movements of the arm, with the first shoulder pivot joint crossing the patient's shoulder joint with its joint axis linked to the arm rail via a curved or angled connecting arm.

To be able to manually adjust the horizontal adduction and/or anteversion and the horizontal abduction and/or retroversion of the shoulder joint to the desired angle, it is advantageous if the first shoulder pivot joint is designed as a manually adjustable and lockable pivot joint. Another option would be to assign a motor-driven positioning or pivot drive to the first shoulder pivot joint. The pivot joint for anteversion and/or retroversion may also be motor-driven.

To be able to carry out a rotary movement in the patient's shoulder joint, it is advantageous if the arm rail carries a lower arm rest, if the lower arm rest is linked to the arm rail via a third shoulder pivot joint defining a rotary movement, and if the joint axis of the third shoulder pivot joint passes roughly through the point of intersection of the first and second shoulder pivot joint.

If the first shoulder pivot joint is designed as manual pivot joint, the desired angle can be adjusted with particular accuracy if the first shoulder pivot joint is equipped with a scale dial for reading the selected shoulder pivot angle.

If continuous abduction, adduction, elevation and/or rotary movements of the shoulder joint are desired, it is advantageous if the first, the second and/or the third shoulder pivot joint is fitted with a motorized pivot drive.

A particularly simple embodiment of the invention envisages that the device carrier is designed as a stand which may be positioned in the vicinity of a separate treatment chair such that the first shoulder pivot joint is arranged underneath the patient's seating surface and its joint axis crosses the patient's shoulder joint.

The easy operation of the therapy device according to the invention is enhanced further if the device carrier is designed as a treatment chair for the patient.

A preferred further embodiment of the invention envisages that the treatment chair is equipped with a seating surface and a backrest and that the angle of inclination of the backrest is adjustable and lockable in order to align the patient's shoulder in relation to the second shoulder pivot joint.

To be able to align the second shoulder pivot joint such that it passes through the patient's shoulder joint, the backrest is simply adjusted from its front neutral position to the appropriate angle of inclination and locked in position.

Another invention proposal relates to a therapy device for the treatment of a shoulder and/or elbow joint using an arm rail composed of at least two rail sections of which one front, free-moving rail section carries a lower arm rest, with the arm rail swivel-attached to a device carrier, and where the lower arm rest and at least the rail section connected to it may optionally be used in mirror fashion for the treatment of the right or the left arm of the patient. The characteristic feature of such a therapy device according to the invention is that at least two rail sections are interlinked via a first rotary and/or pivotal joint with free-moving and lockable motion and that the lower arm rest is rotatable and lockable by means of a second pivot joint attached to the front, free-moving rail section around its longitudinal axis.

Such an embodiment allows the rapid change of sides in the therapy device according to the invention, without the need for specially trained, skilled or qualified personnel. To be able to attach the arm rail from the patient's right arm to the left arm, only the front rail section needs to be swiveled in a horizontal or vertical level, followed by the rotation of the lower arm rest at the front free-moving rail section and turning to the side of the arm rail facing the patient. The therapy device according to the invention therefore allows the change of sides with effortless ease. The handling of the therapy device according to the invention is thereby facilitated substantially.

To be able to treat the patient's arm in an angled and preferably right-angled position of lower and upper arm, it is advantageous if the first and the second rotary joint have an angle of rotation of at least 90° and preferably of at least 180°.

The rail sections of the therapy device according to the invention can be fixed particularly securely and firmly in their respective position relative to each other if the first and/or the second rotary joint is lockable in its rotary position by means of a latch or friction clutch coupling.

To be able to move the therapy device easily to a convenient body position both for the treatment of the patient's left and the right arm without having to change the rail sections of the arm rail in their length and realigning these sections, it is advantageous if the central longitudinal axes of the part sections of the connecting arm engaging at the second shoulder pivot joint and of the rail section of the arm rail are arranged approximately at the pivot level of the second shoulder pivot joint. A second embodiment of the invention intended for the same purpose provides that the central longitudinal axis of the lower arm rest in its rotary position offset by 180° and the rotary axis of the second pivot joint are arranged roughly on the same level.

It is a particularly advantageous option if the arm rail is detachably attached to one of two sides of the treatment chair. A preferred further embodiment of the invention provides that the connecting arm has at least two detachable arm sections, that a first shoulder pivot joint is provided on both sides of the treatment chair and that each first shoulder pivot joint carries a first arm section of the connecting arm, with such arm section being detachably linked to the arm rail via at least one second arm section of the connecting arm.

To ensure that the patient is capable of conveniently and comfortable resting one arm while the other arm is treated, it is expedient if a pivot joint is detachably connectable from the first shoulder pivot joints on both sides of the treatment chair with the arm rail and if a pivot joint arranged on the other side of the chair is detachable connected to an armrest.

Both arm sections of the connecting arm are particularly easily linked to each other without tools if the arm section engaging in a first shoulder pivot joint and the arm section connected with the arm rail or the armrest intermesh telescopically.

To be able to adapt the therapy device according to the invention easily to the patient's body dimensions and to be able to position the second shoulder pivot joint such that its joint axis crosses the patient's shoulder axis, it is expedient if the intermeshing arm sections are adjustable in longitudinal direction and interlockable in definable spacings.

Further features of the invention result from the following description of a specimen of the invention in connection with the claims and from the drawing. The individual features may be realized individually or severally according to the invention.

DETAILED DESCRIPTION OF PREFERRED EMBODIMENTS

Figure 3:
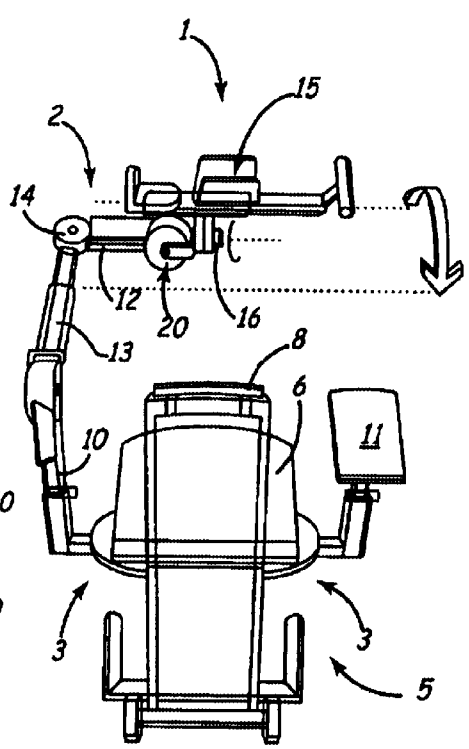
FIG. 3 shows the therapy device from FIGS. 1 and 2 now aligned for treating the patient's left arm after changing the sides.
Figure 2:
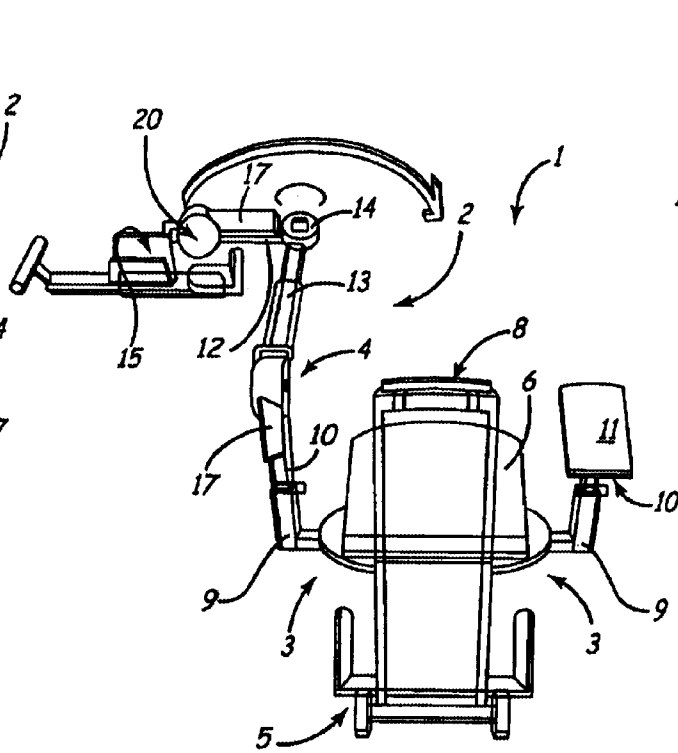
FIG. 2 shows the therapy device in an intermediate position during the change of sides.
Figure 1:
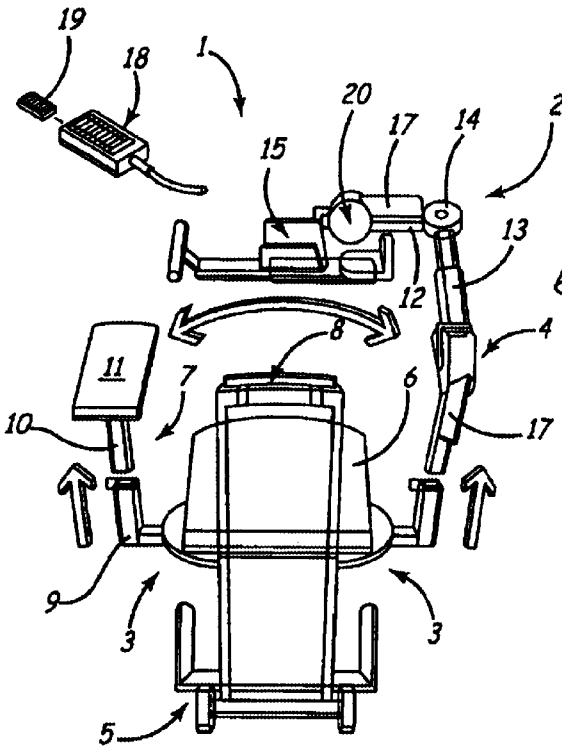
FIG. 1 shows a therapy device for the continuous passive motion of a patient's shoulder and elbow joint, with the therapy device in FIG. 1 aligned for the treatment of the patient's right arm.

FIGS. 1 to 3 show a therapy device serving the continuous passive motion of a patient's shoulder and elbow joint. Such motion therapy may be indicated, for instance, for postoperative treatment and for the treatment of injuries and disorders of the shoulder joint.

The therapy device 1 has an arm rail 2 serving as body carrier element which is held in a device carrier using shoulder pivot joint 3, 4 such that the point of intersection of their joint axes are positioned roughly in the patient's shoulder region. The device carrier is here designed as a treatment chair 5.

While a first shoulder pivot joint 3 defines a horizontal pivot level, a second shoulder pivot joint 4 is to allow a vertical swivel movement of the arm rail 2.

FIGS. 1 to 3 show that the first shoulder pivot joint 3 is arranged underneath the patient's seating surface 6. This first shoulder pivot joint 3 is therefore arranged near the patient's head without interfering. The arm rail 2 is held at the first shoulder pivot joint 3 via a connecting arm 7, with the second shoulder pivot joint 4 arranged between the arm rail 2 and the connecting arm 7.

The treatment chair 5 serving as device carrier has a seating surface 6 and a backrest 8. To be able to align the patient's shoulder such that the joint axis of the second shoulder pivot joint 4 passes through the patient's shoulder joint, the angle of inclination of the backrest 8 is adjustable and lockable.

To be able to detachably attach the arm rail 2 optionally to one of two opposing sides of the treatment chair 5, one first shoulder pivot joint 3 each is provided on both sides of the treatment chair 5.

Each of these shoulder pivot joints carries an approximately L-shaped and angled arm section 9 into which a second arm section 10 of the essentially two part connecting arm 7 is pushed in. From the first shoulder pivot joints 3 provided on both sides of the treatment chair, a pivot joint 3 with arm rail 2 and a pivot joint 3 with an arm rail 2 is alternatingly detachably connected on opposite sides of the chair. A second arm section 10 is assigned each to the arm rest 1 I1 and the arm rail 2.

The telescopically engaging arm sections 9, 10 are adjustable in longitudinal direction and lockable in definable spacings such that the treatment chair 5 is adjusted to the patient's body dimensions and that the height of the second shoulder pivot joint 4 is adjustable until its joint axis passes through the patient's shoulder joint. Such height adjustment of the shoulder pivot joint 4 and the appropriate adjustment of the angle of inclination of the backrest allows the shoulder pivot joints 3, 4 to be aligned accurately with the position of the patient's shoulder joint to be treated.

The comparison of FIGS. 1 to 3 demonstrates that the therapy device 1 shown here allows the quick and convenient change of sides of the arm rail 2. To perform the change, the arm sections 10 connected with the arm rail 2 and with the armrest 11 are detached from the L-shaped arm section 9 of the corresponding shoulder pivot joint 3 and interchanged. The arm rail 2, originally located on the right side of the treatment chair 5 in FIG. 1, is now held in the intermediate position on the left side of the treatment chair, as shown in FIG. 2. The arm rail 2 has two rail sections 12, 13 interconnected via a first rotary joint 14. By swiveling by 180°, the front, free-moving rail section 12 is moved into a position in which it points at a right angle to rail section 13 toward the inside of the treatment chair 5.

A lower arm rest is provided at the front, free-moving rail section 12 which is rotatable around the longitudinal rail axis of the rail section 12 by means of a second pivot joint 16. By turning the lower arm rest 15 at the rail section 12 by 180°, the lower arm rest 15 can finally be moved into a functional position in which its is arranged on the patient-facing side of the rail section 12.

The handling properties of the therapy device 1 shown here are substantially facilitated if the first and second rotary joint 14, 16 and, if required, the first shoulder pivot joint 3 are lockable in their rotary position by means of a latch or friction clutch coupling.

The patient's arm to be treated is held with its lower arm on the lower arm rest 15 in a virtually right-angled arm position. To be able to perform continuous passive elevation, abduction or adduction movements at the patient's shoulder joint, the second shoulder pivot joint 4 is equipped with a swivel drive 17. To be able to perform continuous passive rotary motions of the patient's elbow joint, the lower arm rest 15 is held at the front free-moving rail section 12 by a pivot joint 20 which is also equipped with a pivot drive 17. While the first shoulder pivot joint 3 allows the anteversion and/or retroversion of the shoulder joint, and while the second shoulder pivot joint 4 allows the abduction and adduction motion of the shoulder joint, the rotation of the shoulder joint can be achieved with the help of the third shoulder pivot joint 20. Similarly to the second shoulder pivot joint 4 and the third shoulder pivot joint 20, the shoulder pivot joint 3 provided on both sides of the treatment chair 5 may also be equipped with a pivotal drive.

The pivot drives 17 are control-connected with a control device equipped with a control program reader 18. The control program reader 18 is designed for reading machine-readable control program data media 19 on which individual and personalized patient control data are stored. As shown in FIG. 1, these control program data media 19 are designed as chip cards.

The therapy device 1 can be adjusted to suit the patient's individual body dimensions. By readjusting and locking the arm sections 9, 10, the second shoulder pivot joint 4 can be adjusted to suit the height of the patient's shoulder joint. By changing the angle of inclination of the backrest of the treatment chair 5, the first shoulder pivot joint 3, respectively the second shoulder pivot joint 4 can be aligned such that their joint axes cross in the patient's shoulder joint. The telescopic rail sections 12, 13 are finally adjustable in length and lockable, such that the arm rail 2 can be aligned to suit the patient's individual arm length.

The therapy device 1 shown here excels through its particularly easy and convenient handling characteristics.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A therapy device comprising:

a seating surface having a topside and underside;

at least one body support element which is movable by means of a motion drive to perform the continuous passive body motions of a patient, said body support element including (i) a connecting arm comprising a substantially non-linear connecting portion operably coupled with a first shoulder pivot joint defining a substantially horizontal pivot level in pivotal engagement with the underside of said seating surface; and (ii) an arm rail having an arm rail portion, a substantially linear connecting portion, a second shoulder pivot joint defining a substantially vertical pivot level in pivotal engagement with said arm rail portion and said substantially linear connecting portion, said substantially linear connecting portion operably received by said substantially non-linear connecting portion; and a control device, operably connected to the motion drive, wherein the control device includes a control program reader that cooperates with a machine-readable control program data media that can be read into the control program reader, said data media carrying a personalized and individual patient information control program.

2. The therapy device of claim 1, wherein the control program data media is a card having a magnetic strip.

3. The therapy device of claim 1 wherein the control program data media is a chip cards.

4. The therapy device of claim 1 wherein the therapy device is designed for the treatment of a joint in the body of a patient.

5. The therapy device of claim 1 wherein an imaginary line drawn through the axis of the first shoulder pivot joint and an imaginary line drawn through the axis of the second shoulder pivot joint intersect at a point proximate the patient's shoulder.

6. The therapy device of claim 1 wherein the first shoulder pivot joint is designed as a manually adjustable and lockable pivot joint.

7. The therapy device of claim 1 wherein the first shoulder pivot joint includes a scale dial for reading a selected shoulder pivot angle.

8. The therapy device of claim 1 further comprising a lower arm rest attached to the arm rail.

9. The therapy device of claim 8 wherein the lower arm rest is attached to the arm rail via a third shoulder pivot joint defining a rotary movement, the joint axis of the third shoulder pivot joint aligned to pass approximately through the point of intersection of the first and second shoulder pivot joint axes.

10. The therapy device of claim 1 wherein the motion drive is operably attached to the first shoulder pivot joint.

11. The therapy device of claim 1 wherein the motion drive is operably attached to the second shoulder pivot joint.

12. The therapy device of claim 1 wherein the motion drive is operably attached to the third shoulder pivot joint.

13. The therapy device of claim 1 wherein the therapy device is configured as a stand.

14. The therapy device of claim 1 wherein the therapy device is configured as a treatment chair.

15. The therapy device of claim 14, wherein the treatment chair is equipped with a seating surface and a backrest and that the angle of inclination of the backrest is adjustable and lockable to align the patient's shoulder in relation to the second shoulder pivot joint.

16. The therapy device of claim 14 wherein the treatment chair includes a right side first shoulder pivot joint and a left side first shoulder pivot joint, wherein the arm rail is detachably connectable to either the right side first shoulder pivot joint or the left side first shoulder pivot joint.

17. The therapy device of claim 16 further comprising an arm rest attachable to either the right side first shoulder pivot joint or the left side first shoulder pivot joint.

18. The therapy device of claim 1 wherein the arm rail is configured for the treatment of a patient's shoulder and is adjustable for the treatment of both the left and the right shoulder, the arm rail further comprising a first rail section which carries the lower arm rest and is movable and lockably linked to a first rotary joint, the arm rail further comprising a second rail section also movably and lockably linked to the first rotary joint, the second rail section attached at an opposite end to the second shoulder joint, the lower arm rest being adjustable carried on the first rail section via a second rotary joint.

19. The therapy device of claim 18 wherein the first and the second rotary joint each has an angle of rotation of at least 90°.

20. The therapy device of claim 19 wherein the first rotary joint allows the rotational movement of the first arm section and the second arm section in a roughly horizontal level.

21. The therapy device of claim 18 wherein the first rotary joint includes a latch coupling for locking in a desired rotary position.

22. The therapy device of claim 18 wherein the second rotary joint includes a latch coupling for locking in a desired rotary position.

23. The therapy device of claim 18 wherein the central longitudinal axis of the lower arm rest and the rotary axis of the second rotary joint are roughly arranged on one level.

24. The therapy device of claim 1 wherein the arm rail is optionally and detachably attached to one of two opposing sides of the treatment chair.

25. The therapy device of claim 1 wherein the non-linear connecting arms are telescopically adjustable.

26. The therapy of claim 25 wherein the non-linear connecting arms are lockable in a desired position.

* * * * *

UNITED STATES PATENT AND TRADEMARK OFFICE

CERTIFICATE OF CORRECTION

PATENT NO. : 6,695,795 B2
DATED : February 24, 2004
INVENTOR(S) : Gerd Knoll

It is certified that error appears in the above-identified patent and that said Letters Patent is hereby corrected as shown below:

Column 7,
Line 45, delete “claim 1”, and insert -- claim 9 --.

Column 8,
Line 19, delete “movable”, and insert -- movably --.
Line 24, delete “adjustable”, and insert -- adjustably --.
Line 47, after “therapy”, insert -- device --.

Signed and Sealed this

Fourteenth Day of September, 2004

JON W. DUDAS
*Director of the United States Patent and Trademark Office*